United States Patent [19]

Osborn

[11] 4,124,396

[45] Nov. 7, 1978

[54] 2,5-DICARBONYLAMINOPHENOL DYE-FORMING COUPLERS

[75] Inventor: Harland J. Osborn, Rochester, N.Y.

[73] Assignee: Eastman Kodak Company, Rochester, N.Y.

[21] Appl. No.: 774,087

[22] Filed: Mar. 3, 1977

[51] Int. Cl.[2] ..... G03C 7/00; G03C 1/40

[52] U.S. Cl. ..... 96/100 R; 96/56.6

[58] Field of Search ..... 96/100, 56.6

[56] References Cited

U.S. PATENT DOCUMENTS

| | | | |
|---|---|---|---|
| 2,484,477 | 10/1949 | Weissberger et al. | 260/309 |
| 2,536,010 | 12/1950 | Schmidt et al. | 96/100 |
| 2,569,906 | 10/1951 | Starke | 96/100 |
| 2,772,162 | 11/1956 | Salimen et al. | 96/100 |
| 3,222,176 | 12/1965 | Jaeken | 96/100 |
| 3,758,308 | 9/1973 | Beavers et al. | 96/100 |
| 3,880,661 | 4/1975 | Lau et al. | 96/100 |

FOREIGN PATENT DOCUMENTS

| | | |
|---|---|---|
| 1,111,554 | 5/1968 | United Kingdom. |
| 1,268,550 | 3/1972 | United Kingdom. |

*Primary Examiner*—Richard L. Schilling
*Attorney, Agent, or Firm*—Joshua G. Levitt

[57] ABSTRACT

2,5-Dicarbonylaminophenols containing a p-alkyl-sulfonylaminophenoxy terminal moiety or a p-alkylamino-sulfonylphenoxy terminal moiety in the five-position substituent of the molecule are color-forming couplers useful in photographic silver halide emulsions and elements.

10 Claims, No Drawings

2,5-DICARBONYLAMINOPHENOL DYE-FORMING COUPLERS

This invention relates to a novel class of phenolic cyan dye-forming couplers and to photographic silver halide emulsions and elements containing such couplers. Specifically, this invention relates to a class of 2,5-dicarbonylamino phenolic couplers containing a p-alkylsulfonylaminophenoxy terminal moiety or a p-alkylaminosulfonylphenoxy terminal moiety in the five-position substituent of the phenol.

Color images are customarily obtained in the photographic art by a coupling reaction between the development product of silver halide developing agent (i.e. oxidized aromatic primary amino developing agent) and a color-forming or coupling compound. The dyes produced by coupling are indoaniline, azomethine, indamine, or indophenol dyes, depending upon the chemical composition of the coupler and of the developing agent. The subtractive process of color formation is ordinarily employed in multicolor photographic elements and the resulting image dyes are usually cyan, magenta and yellow dyes which are formed in or adjacent silver halide layers sensitive to radiation complementary to the radiation absorbed by the image dye; i.e., silver halide emulsions sensitive to red, green, and blue radiation. The couplers which typically are employed to produce cyan dyes are phenols or napthols and they yield indoaniline or indophenol dyes upon coupling with oxidized aromatic primary amino developing agents.

Many of the color photographic couplers employed are four-equivalent couplers. In other words, they require the development of four molecules of silver halide in order to ultimately produce one molecule of dye. Also known and used are two-equivalent couplers which require the development of two molecules of silver halide to produce one molecule of dye.

Although numerous cyan dye-forming couplers are known, there is a continuing search for novel such couplers which improve upon existing couplers, or optimize for particular applications such properties of the coupler as stability and general compatibility with other components in the element and such properties of the resultant dye as stability, hue, color balance and the like. Lau et al. U.S. Pat. No. 3,880,661, issued April 29, 1975, describes a class of phenolic and α-naphtholic cyan dye-forming couplers containing a p-hydroxy-alkylphenoxyalkylcarbonylamino substituent. These couplers provide high dye yields and the dyes obtained from them have improved stability compared with analogous structures. However, it has been found that couplers of U.S. Pat. No. 3,880,661 have a tendency to crystallize in gelatin emulsions.

I have found phenolic cyan dye-forming couplers which share the desirable properties of the couplers of U.S. Pat. No. 3,880,661 and do not tend to crystallize in photographic emulsions. My novel cyan dye-forming couplers are 2,5-dicarbonylaminophenols wherein the five-position substituent of the phenol is terminated with a p-alkylsulfonylaminophenoxy moiety or with a p-alkylaminosulfonylphenoxy moiety. Couplers of this invention advantageously can be represented by the structural formula

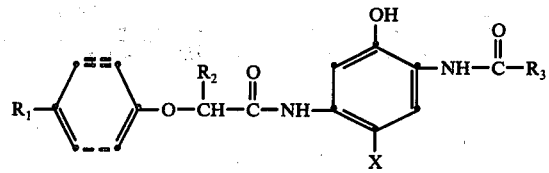

where $R_1$ is $R_4SO_2NH$— or $R_4NHSO_2$—;

$R_2$ is hydrogen or alkyl of 1 to 20 carbon atoms;

$R_3$ is phenyl, substituted phenyl, alkyl of 1 to 20 carbon atoms or substituted alkyl of 1 to 20 carbon atoms;

$R_4$ is alkyl of 1 to 20 carbon atoms and together $R_2$ and $R_4$ contain a total of 8 to 32 carbon atoms, and X is a coupling-off group.

Alkyl groups represented by $R_2$, $R_3$ and $R_4$ can be straight or branch chained.

The groups represented by $R_2$, $R_3$, and $R_4$ should be of such size and configuration that together they confer upon the coupler molecule sufficient bulk so that the coupler is substantially non-diffusible in the layer in which it is coated. Bearing this in mind, those skilled in the art will recognize that equivalent groups can be employed.

In a preferred embodiment of this invention, $R_2$ is alkyl of 8 to 16 carbon atoms, $R_4$ is alkyl of 1 to 6 carbon atoms and together $R_2$ and $R_4$ contain a total of 14 to 20 carbon atoms. In a particularly preferred embodiment of this invention $R_2$ is dodecyl and $R_4$ is butyl.

Preferred $R_3$ groups are alkyl, haloalkyl, phenyl, halophenyl, alkylphenyl, alkoxyphenyl and alkylaminosulfonyl; wherein each alkyl moiety contains 1 to 6 carbon atoms. Phenyl is a particularly preferred $R_3$ group.

Coupling-off groups defined by X are well known to those skilled in the art. Such groups can determine the equivalency of the coupler (i.e., whether it is a two-equivalent coupler or a four-equivalent coupler), can modify the reactivity of the coupler, or can advantageously affect the layer in which the coupler is coated or other layers in the element by performing on release from the coupler such functions as development inhibition, bleach inhibition, bleach acceleration, color correction and the like. Representative of such coupling-off groups are hydrogen, halogen, alkoxy, aryloxy, arylazo, thioether, and heterocyclic groups such as oxazoyl, diazolyl, triazolyl, and tetrazolyl. Preferred coupling-off groups are hydrogen and chloro.

Couplers within the scope of the present invention are exemplified in Table I below, with reference to Formula I.

TABLE I
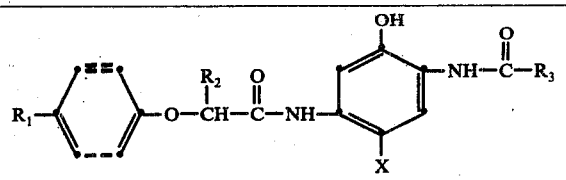
I
| Coupler No. | $R_1$ | $R_2$ | $R_3$ | X |
|---|---|---|---|---|
| 1 | $C_2H_5SO_2NH$— | n-$C_{16}H_{33}$— | —$C_3F_7$ | —H |
| 2 | n-$C_6H_{13}SO_2NH$— | n-$C_8H_{17}$— | —$CF_3$ | —O— |
| 3 | n-$C_4H_9SO_2NH$— | n-$C_{12}H_{25}$— | —$C_3F_7$ | —Cl |
| 4 | n-$C_4H_9SO_2NH$— | n-$C_{12}H_{25}$— | | —Cl |
| 5 | t-$C_4H_9SO_2NH$— | n-$C_{14}H_{29}$— | | —H |
| 6 | n-$C_6H_{13}SO_2NH$— | n-$C_{10}H_{21}$— | —Cl | —O—$CH_3$ |
| 7 | n-$C_4H_9SO_2NH$— | n-$C_{12}H_{25}$— | —Cl | —Cl |
| 8 | $C_2H_5SO_2NH$— | n-$C_{16}H_{33}$— | —Br | —H |
| 9 | n-$C_4H_9SO_2NH$— | n-$C_{12}H_{25}$— | —Cl | —S— |
| 10 | n-$C_6H_{13}SO_2NH$— | n-$C_{12}H_{25}$— | | —S— |
| 11 | t-$C_4H_9SO_2NH$— | n-$C_{10}H_{21}$— | —$SO_2NHC_4H_9$-n | —H |
| 12 | n-$C_4H_9SO_2NH$— | n-$C_{12}H_{25}$— | —$SO_2NHC_4H_9$-n | —Cl |
| 13 | $C_2H_5SO_2NH$— | n-$C_{14}H_{29}$— | —$C_2F_5$ | —S— |
| 14 | n-$C_4H_9SO_2NH$— | n-$C_{12}H_{25}$— | | —N— |

TABLE I-continued

I

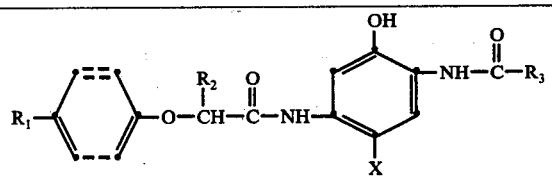

| Coupler No. | $R_1$ | $R_2$ | $R_3$ | X |
|---|---|---|---|---|
| 15 | n-$C_6H_{13}SO_2NH$— | n-$C_{10}H_{21}$— | 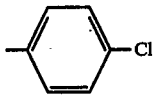 | 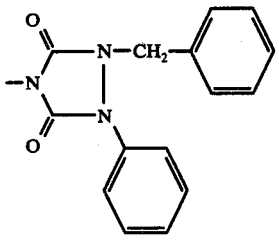 |
| 16 | n-$C_{12}H_{25}NHSO_2$— | $C_2H_5$— | —$C_4H_9$-n | —H |
| 17 | n-$C_4H_9NHSO_2$— | n-$C_{12}H_{25}$— | 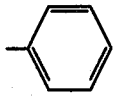 | —Cl |
| 18 | n-$C_6H_{13}NHSO_2$— | n-$C_8H_{17}$— | 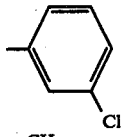 | —O—$C_2H_5$ |
| 19 | t-$C_4H_9NHSO_2$— | n-$C_{14}H_{29}$— | —$CH_3$ | 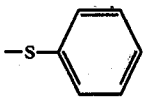 |
| 20 | n-$C_4H_9NHSO_2$— | n-$C_{12}H_{25}$— | 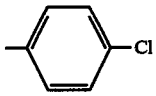 | —Cl |
| 21 | $C_2H_5NHSO_2$— | n-$C_{16}H_{33}$— | —$C_3F_7$ | H |
| 22 | n-$C_{16}H_{33}NHSO_2$— | H— | 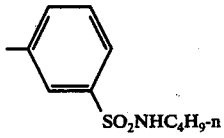 | H |

The p-alkylsulfonylaminophenoxy couplers of the present invention can be prepared by the reaction sequence illustrated below wherein $R_4$, $R_2$, $R_3$ and X are as defined above.

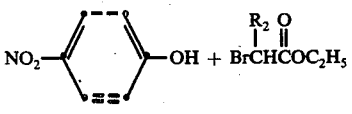

(A)

$K_2CO_3$
Acetone

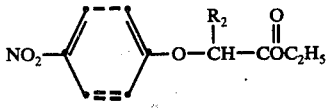

(B)

$H_2$

-continued

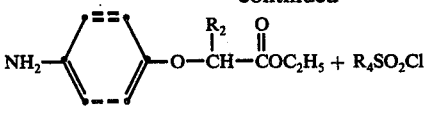

(C)

Tetrahydrofuran/pyridine

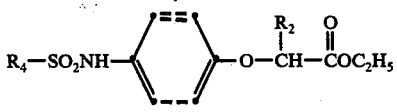

(D)

1. $OH^{\ominus}$
2. $SOCl_2$

-continued

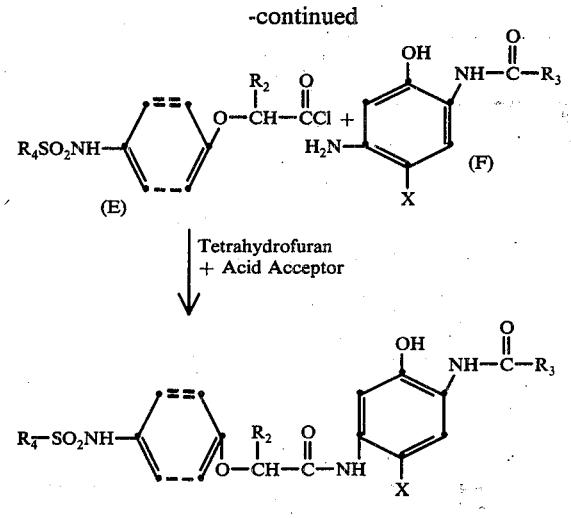

In this reaction sequence p-nitrophenol (A) is reacted with the ethyl ester of an α-bromoalkanoic acid in refluxing acetone and excess potassium carbonate to give the α-[p-nitrophenoxy] alkanoate (B). The nitro group is reduced under 2 to 3 atmospheres of hydrogen in the presence of Raney Nickel catalyst in denatured ethanol. The resultant aminophenoxy compound (C) is condensed with an alkylsulfonyl chloride in tetrahydrofuran/pyridine to give the α-[p-(alkylsulfonylaminophenoxy)] alkanoate (D). This ester is hydrolyzed in ethanolic sodium hydroxide, which upon neutralization gives the solid acid, which is purified by recrystallization. Conversion of the acid to the acid chloride (E) is accomplished by refluxing in thionyl chloride. The acid chloride is then condensed with the 2-carbonylamino-4-chloro-5-aminophenol (F) in tetrahydrofuran using an acid acceptor such as quinoline or dimethyl aniline, giving the final coupler, which is then purified by recrystallization.

In this sequence reactant F is obtained by the technique shown in columns 4 and 5 of Lau et al U.S. Pat. No. 3,880,661 through Step (g).

The p-alkylaminosulfonylphenoxy couplers of the present invention can be prepared by a similar reaction sequence. In this reaction p-hydroxybenzenesulfonyl chloride is reacted with an alkyl amine containing the desired $R_4$ group to yield the alkylaminosulfonylphenol. This phenol is reacted with an ester of α-bromoalkanoic acid containing the desired $R_2$ group, as in the reaction described above, to give the α-[p-alkylaminosulfonylphenoxy)] alkanoate. This ester is hydrolyzed, converted to the acid chloride, and condensed with the 2-carbonylamino-4-chloro-5-aminophenol (F), as in the reaction described above.

Preparation of a specific coupler within the scope of the present invention is illustrated in Example 1 of this application.

The cyan dye-forming couplers of this invention are usefully incorporated in photographic silver halide emulsions and elements. The couplers can advantageously be incorporated in photographic silver halide emulsions by a variety of known techniques. Preferred techniques are described, for instance, in Mannes et al U.S. Pat. No. 2,304,939–940 and Jelley et al. U.S. Pat. No. 2,322,027, in which the coupler is first dissolved or dispersed in a high boiling organic solvent and then blended with the silver halide emulsion; and in Vittum et al. U.S. Pat. No. 2,801,170, Fierke et al. U.S. Pat. No. 2,801,171 and Julian U.S. Pat. No. 2,479,360, in which low boiling or water-miscible organic solvents are used in conjunction with or in place of a high boiling organic solvent to dissolve or disperse the coupler.

The silver halide emulsion, containing the coupler, can be used as the sole layer in a photographic element. Alternatively and preferably, the silver halide emulsion can be used to form one of the layers in a multilayer multicolor photographic element. When incorporated in such elements, useful concentrations of the coupler generally will be in the range of about 25 to 200 milligrams of coupler per square foot of coating.

While multicolor multilayer photographic elements are known with a variety of layers and a variety of configurations, a typical element in which the couplers and emulsions of this invention can be incorporated would have the following main components:

(A) A support, such as cellulose nitrate film, cellulose acetate film, polyvinylacetal film, polystyrene film, poly(ethylene terephthalate) film, polyethylene film, polypropylene film and related films of resinous materials as well as paper, polyethylene-coated paper, glass and other known support materials.

(B) An antihalation layer such as described, for instance, in Glafkides "Photographic Chemistry" Volume 1, pages 470–471, Arrowsmith Ltd., 1958.

(C) A plurality of light-sensitive coupler-containing silver halide emulsion layers on the support, optionally with one or more gelatin layers between. Preferably, the element contains red-sensitive, green-sensitive and blue-sensitive silver halide emulsion layers. The support is conveniently coated in succession with a red-sensitive layer containing one or more cyan-dye-producing couplers including at least one of the above-defined class of cyan-dye producing coupler, a green-sensitive layer containing one or more magenta-dye-producing couplers and a blue-sensitive layer, containing one or more yellow-dye-producing couplers, preferably with a yellow filter layer (e.g. Carey-Lea silver) between the blue- and green-sensitive layers. Alternatively, the dye-producing couplers can be coated in layers adjacent the light-sensitive layers with which they are associated. The light-sensitive layers can also be arranged in any other order that is desirable, with the exception that a yellow filter layer should not be placed over a blue-sensitive layer. The light-sensitive layers can be divided into sublayers having the same or different sensitometric and/or physical properties, such as photographic speed, size, distribution of components, etc., and these sublayers can be arranged in varying relationships.

The light-sensitive silver halide emulsions can include coarse, regular, or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. Suitable such emulsions are described, for instance, in "The Photographic Journal," Volumn LXXIX, May 1939, pages 330–338; "Journal of Photographic Science," Volumn 12, No. 5, Sept/Oct 1964, pages 242–251, and also in U.S. Pat. Nos. 2,184,013; 2,456,953; 2,541,472; 2,563,785; 3,367,778 and 3,501,307. Such silver halide emulsions typically are gelatin emulsions although other hydrophilic colloids can be used in accordance with usual practice.

(D) One or more gelatin or hydrophilic spacer layers between the light-sensitive emulsion layers or the emulsion layers and the yellow filter layer as above described. The spacer layers preferably contain compounds which prevent the interlayer migration of development products which are not desired in adjacent layers, such as oxidized developing agents. Suitable compounds for this purpose are scavengers described in, e.g. U.S. Pat Nos. 2,360,290; 2,403,721 and 2,701,197; and British Pat. No. 700,453.

(E) A protective water-permeable overcoat layer, such as gelatin or other hydrophilic colloids. The overcoat may conveniently contain aldehyde scavenger such as described for instance, in U.S. Pat. Nos. 3,236,652; 3,287,135; 3,220,839; 2,403,927; and British Pat. No. 623,448, and other ingredients such as buffering agents (e.g., in acidic or basic material), and ultraviolet light absorbers.

This invention is further described, although not limited, by the following examples, which illustrate the preparation of a representative coupler of this invention (Example 1), the preparation and use of a photographic element containing couplers of this invention (Example 2) and a comparison, with respect to crystallization stability, of couplers of this invention with couplers of U.S. Pat. No. 3,880,611 (Example 3).

EXAMPLE 1

Synthesis of Coupler No. 4 — 2-Benzoylamino-4-chloro-5-[α-(p-butylsulfonylamino-phenoxy)-α-(dodecyl)acetylamino]phenol

A. Preparation of Ethyl-α-[p-nitrophenoxy]tetradecanoate (Intermediate I)

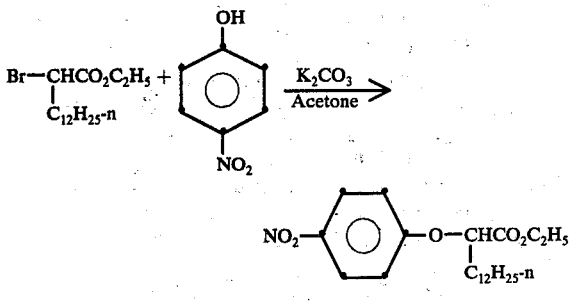

I 153 g (1.1 mol) of p-nitrophenol, 1.3 liters acetone and 336 g (1.0 mol) of ethyl-α-bromo-tetradecanoate were placed in a 5-liter 3-necked flask and heated on a steam bath with stirring, for 60 hours. The product was filtered to remove inorganic salt and then the acetone was distilled off under vacuo. The residual oil was taken up in hexane, filtered, and concentrated under vacuo. Yield of Intermediate I was 361 g. TLC Analysis (benzene) showed only one spot, indicating a single product.

B. Preparation of Ethyl-α-[p-butylsulfonyl aminophenoxy]tetradecanoate (Intermediate II)

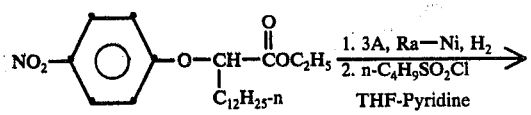

-continued

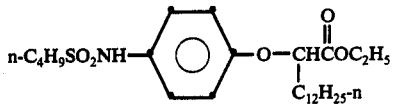

II 1. 87 g (0.22 mol) of ethyl-α-[p-nitrophenoxy]tetradecanoate (Intermediate I) obtained in Step A, 1000 ml absolute ethanol and 2½ teaspoonfuls of Raney nickel were placed in a Paar bottle. The mixture was reduced under 40 pounds per square inch of hydrogen. Reduction was completed in 1 hour. The catalyst was filtered off and the filtrate was concentrated under vacuo to yield 69.5 g of a light oil which was used in the next step of the reaction.

2. The light oil obtained above was dissolved in 600 ml of tetrahydrofuran and 16 g of pyridine. To the solution was added with stirring 31 g (0.2 mol) of n-butanesulfonyl chloride in 100 ml tetrahydrofuran over a 15 minute period. The mixture was heated on a steam bath for 1.0 hour. After cooling, it was poured into 1.0 liter of ice water and 100 ml of concentrated hydrochloric acid, then extracted with ether and dried over magnesium sulfate. The ether was removed under vacuo to give 92 g of oil. TLC analysis (benzene) showed it to be the essentially pure Intermediate II.

C. Prepration of α-[p-butylsulfonylaminophenoxy]tetradecanoic acid (Intermediate III)

92 g (0.19 mol) of ethyl-α-[p-butylsulfonylamino-phenoxy]tetradecanoate (Intermediate II) obtained in Step B, and 500 ml of ethyl alcohol were placed in a 3-necked flask. A solution of 20 g of sodium hydroxide (dissolved in a minimum amount of water) was added with good stirring. The reaction mixture was refluxed for 3 hours, allowed to cool to room temperature, poured into ice water and acidified with concentrated hydrochloric acid. The oil was extracted with ether, washed with water and saturated sodium chloride solution. The ether was removed under vacuo to give a gummy solid. After trituration with ligroine (boiling point: 35°–60° C.), the solid was collected. Yield was 50 g of Intermediate III, m.p. 80°–82° C. TLC analysis (benzene) showed one product.

D. Preparation of Coupler No. 4

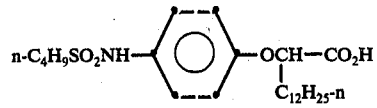

III

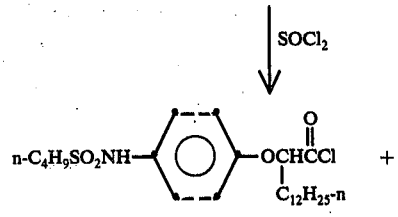

-continued

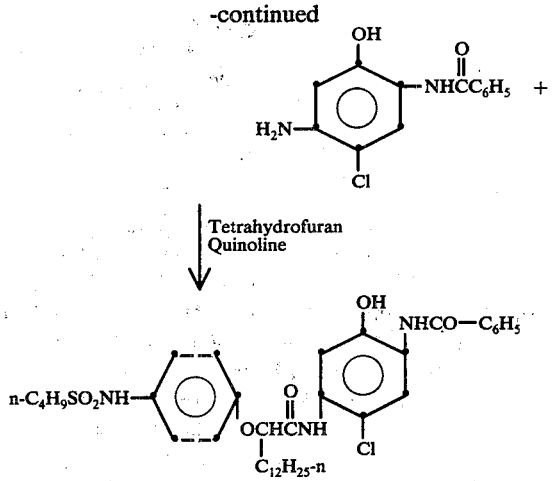

24 g (0.05 mol) of α-[p-butylsulfonylaminophenoxy]-tetradecanoic acid (Intermediate III) obtained in Step C and 70 ml thionyl chloride were placed in a 500 ml round bottom flask and refluxed for 1.0 hour. Excess thionyl chloride was removed under vacuo leaving an oil. The oil was taken up in 50 ml tetrahydrofuran and added in a steady stream to a well-stirred solution of 13.2 g (0.05 mol) of 2-benzamido-4-chloro-5-aminophenol (obtained by the procedure described in Example 1 of U.S. Pat. No. 3,880,661) in 200 ml tetrahydrofuran and 13.0 g (0.1 mol) of quinoline. The temperature during the addition was maintained at 5°–15° C. with an ice bath. After stirring for ½ hour, the ice bath was removed and the reaction mixture was stirred at room temperature for 2 hours. It was then poured into 500 ml ice water and 20 ml concentrated hydrochloric acid. The oil was extracted with ether, washed with water, and dried over magnesium sulfate. The ether was removed under vacuo to give a gummy solid. The gum was dissolved in boiling acetonitrile. Upon chilling, the product crystallized out to give 19 g of Coupler No. 4; m.p. 130°–131° C.

EXAMPLE 2

Preparation and Evaluation of a Photographic Effect

Photographic film strips were prepared by coating a transparent cellulose acetate support with light-sensitive gelatino silver bromoiodide emulsion coating to obtain 136 mg silver/ft², 450 mg gelatin/ft², and 109 mg/ft² of coupler No. 4 dissolved into 55 mg/ft² of di-n-butyl phthalate. The coated strips were sensitometrically exposed through a graduated density test object for 1/50 second at 3000° K. and processed at 20° C. One set of strips being treated with Color Developing Solution A and another with Color Developing Solution B described below. The strips were then stopped, washed, silver bleached, washed, fixed, washed, stabilized and dried in the usual manner. Thereafter they were tested as explained below, and evaluated to determine their maximum image dye density, and light and heat fading characteristics. The results are set forth in Table II.

| COLOR DEVELOPING SOLUTION A | |
|---|---|
| $H_2O$ | 800 ml |
| Sodium hexametaphosphate | 0.5 g |
| $Na_2SO_3$ | 2.0 g |
| 4-Amino-3-methyl-N,N-diethylaniline hydrochloride | 2.0 g |
| $Na_2CO_3 \cdot H_2O$ | 20.0 g |
| 50% NaBr Solution | 3.46 ml |
| $H_2O$ to | 1 liter |
| (pH 10.86) | |

| COLOR DEVELOPING SOLUTION B | |
|---|---|
| $H_2O$ | 800 ml |
| Benzyl alcohol | 4.0 ml |
| Sodium hexametaphosphate | 0.5 g |
| $Na_2SO_3$ | 2.0 g |
| 40% NaOH solution | 0.4 ml |
| 4-Amino-3-methyl-N-ethyl-N-β-(methanesulfonamido)-ethylaniline sesquisulfate hydrate | 5.0 g |
| 50% NaBr solution | 1.72 ml |
| $H_2O$ to | 1 liter |
| (pH 10.75) | |

Light Fading Tests

The extent to which the image dye fades under the influence of light was determined by subjecting processed coatings to a simulated 21-day north skylight exposure (SANS) and determining the resulting decrease in dye density in an area having an initial dye density of approximately 1.2. The resulting "Light Fade" is recorded as density units. A positive sign indicates an increase in density, whereas no sign indicates a decrease in density.

The extent to which unreacted coupler causes unwanted stain under the influence of light was determined by exposing processed coatings to SANS, as above described, and recording the resulting increase in density to blue light (420 nm) in a D min area of the coating. This increase is termed "Print Out" and is recorded in terms of percent density increase.

Heat Fading Tests

The extent to which the image dye fades under the influence of heat and humidity was determined by subjecting coatings to a temperature of 60° C. at a relative humidity of 70 percent for 1 week. The resulting decrease in image dye density is termed "Heat Fade" and is recorded in density units. A positive sign indicates an increase in density, whereas no sign indicates a decrease in density.

The effect of heat on unreacted coupler was determined by subjecting coatings to the above heat and humidity conditions, and determining the increase in density to blue light (420 nm), a $D_{min}$ area of the coating. This increase is termed "Yellowing" and is recorded in terms of percent density increase.

TABLE II

| | Developer A | Developer B |
|---|---|---|
| $D_{max}$ | 2.95 | 2.61 |
| $\lambda_{max}$ | 654 | 642 |
| Light Fade | 0.04 | 0.05 |
| % Printout | 1 | 1 |
| Heat Fade (wet) 1 week | +0.01 | +0.03 |
| % Yellowing | 4 | 6 |
| Heat Fade (wet) 2 weeks | +0.01 | 0.00 |
| % Yellowing | 4 | 6 |
| Heat Fade (dry) 1 week | 0.01 | 0.00 |
| Yellowing | 4 | 4 |

This data indicate that the cyan dye produced from couplers of this invention has desirable maximum density, good sensitometric characteristics and good light and heat stability, and that the unreacted coupler has good resistance to formation of stain under the influence of heat and light.

EXAMPLE 3

Dispersion Crystallization Stability Test

Couplers 3, 4, 7, 12, 17 and 20 from Table I and couplers A and B having the structure shown below (couplers 2 and 29 from U.S. Pat. No. 3,880,661), were evaluated for crystallization stability when dispersed in a gelatin emulsion composition

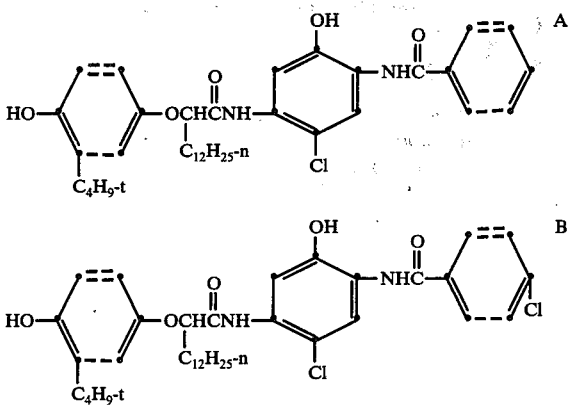

Gelatin dispersions containing each of the couplers were prepared according to the following general formula:

4.0 g coupler
1.33 g 2,4-di-tert-amylphenol
12 g anhydrous ethyl acetate
3.64 g gelatin (29.1 ml of 12½% gelatin)
4 ml sodium triisopropylnaphthalene-1-sulfonate
9 ml water.

The dispersions were noodled, washed, remelted, and examined microscopically (125× magnification) for the presence of coupler crystals. The dispersions were then incubated in a 40° C. water bath for 8 hours and reexamined microscopically (125×) for the presence of coupler crystals.

All the dispersions were rated as either satisfactory (S), unsatisfactory (U), or questionable (Q), before and after incubation. The results are tabulated below.

A satisfactory (S) rating indicates that before incubation the dispersion was observed to contain no crystals, or an insignificant number of crystals, and after incubation there was no change in crystallinity. An unsatisfactory (U) rating indicates the dispersion was observed to contain a significant number of crystals. A questionable (Q) rating indicates that the number of crystals is marginal.

TABLE III

| Coupler | Crystallinity | |
|---|---|---|
| | Pre-Incubation | Post-Incubation |
| A | S | U |
| B | Q | U |
| 3 | S | S→Q |
| 4 | S | S |
| 7 | S | S |
| 12 | S | S |
| 17 | S | S |
| 20 | S | S |

It is observed that Couplers A and B demonstrate unsatisfactory crystallization particularly after incubation. However, couplers of this invention show little or no tendency to crystallize when dispersed in the same manner.

The invention has been described in detail with particular reference to certain preferred embodiments thereof, but it will be understood that variations and modifications can be effected within the spirit and scope of the invention.

What is claimed is:

1. A photographic element comprising a support bearing at least one layer of a photosensitive silver halide emulsion and a cyan dye-forming coupler having the structure

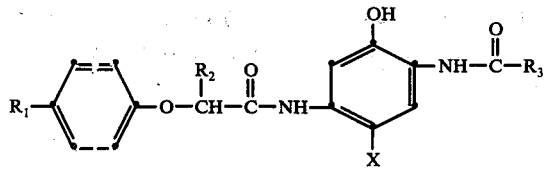

wherein $R_1$ is $R_4SO_2NH$— or $R_4NHSO_2$—;

$R_2$ is hydrogen or alkyl of 1 to 20 carbon atoms;

$R_3$ is phenyl, substituted phenyl, alkyl of 1 to 20 carbon atoms or substituted alkyl of 1 to 20 carbon atoms;

$R_4$ is alkyl of 1 to 20 carbon atoms such that together $R_2$ and $R_4$ contain a total of 8 to 32 carbon atoms; and X is a coupling-off group.

2. A photographic element according to claim 1 wherein $R_2$ is alkyl of 8 to 16 carbon atoms and $R_4$ is alkyl of 1 to 6 carbon atoms and together $R_2$ and $R_4$ contain a total of 14 to 20 carbon atoms.

3. A photographic element according to claim 2 wherein $R_3$ is phenyl or substituted phenyl.

4. A photographic element according to claim 3 wherein X is hydrogen or halogen.

5. A photographic element comprising a support bearing at least one layer of a photosensitive silver halide emulsion containing a cyan dye-forming coupler having the structure

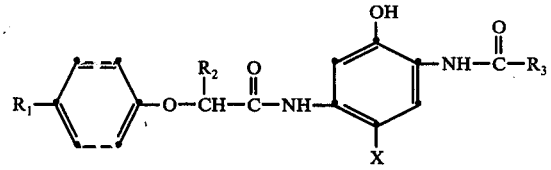

wherein:

$R_1$ is $R_4SO_2NH$—, $R_2$ is dodecyl, $R_3$ is phenyl, $R_4$ is butyl and

X is hydrogen or chloro.

6. A photographic silver halide emulsion containing a cyan dye-forming coupler having the structure

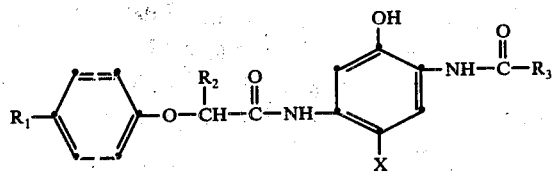

wherein:

$R_1$ is $R_4SO_2NH$— or $R_4NHSO_2$—;

$R_2$ is hydrogen or alkyl of 1 to 20 carbon atoms;

$R_3$ is phenyl, substituted phenyl, alkyl of 1 to 20 carbon atoms or substituted alkyl of 1 to 20 carbon atoms;

$R_4$ is alkyl of 1 to 20 carbon atoms such that together $R_2$ and $R_4$ contain a total of 8 to 32 carbon atoms; and X is a coupling-off group.

7. A photographic silver halide emulsion according to claim 6 wherein $R_2$ is alkyl of 8 to 16 carbon atoms and $R_4$ is alkyl of 1 to 6 carbon atoms and together $R_2$ and $R_4$ contain a total of 14 to 20 carbon atoms.

8. A photographic silver halide emulsion according to claim 7 wherein $R_3$ is phenyl or substituted phenyl.

9. A photographic silver halide emulsion according to claim 8 wherein X is hydrogen or halogen.

10. A photographic silver halide emulsion according to claim 6 wherein:

$R_1$ is $R_4SO_2NH$—, $R_2$ is dodecyl, $R_3$ is phenyl, $R_4$ is butyl and

X is hydrogen or chloro.

* * * * *